United States Patent [19]

Andre et al.

[11] Patent Number: 4,965,836

[45] Date of Patent: Oct. 23, 1990

[54] STEREO HEADPHONE

[75] Inventors: Eugene M. Andre, Port Washington; Allan G. Modzikowski, Milwaukee; Seth R. Banks, Glendale, all of Wis.

[73] Assignee: Koss Corporation, Milwaukee, Wis.

[21] Appl. No.: 299,878

[22] Filed: Jan. 19, 1989

[51] Int. Cl.[5] ..... H04R 1/10

[52] U.S. Cl. ..... 381/183; 381/25; 181/129; 181/144

[58] Field of Search ..... 381/183, 186, 184, 190, 381/182, 153, 158, 159, 25; 181/129, 144, 137

[56] References Cited

U.S. PATENT DOCUMENTS

| | | | |
|---|---|---|---|
| 3,112,005 | 11/1963 | Shaw et al. | 181/129 |
| 3,943,304 | 3/1976 | Piribauer | 381/187 |
| 4,283,606 | 8/1981 | Buck | 381/194 |
| 4,418,248 | 11/1983 | Mathis . . | |

FOREIGN PATENT DOCUMENTS

| | | | |
|---|---|---|---|
| 1187286 | 5/1982 | U.S.S.R. | 181/137 |

*Primary Examiner*—Jin F. Ng
*Assistant Examiner*—M. Nelson McGeary, III
*Attorney, Agent, or Firm*—Fuller, Ryan & Hohenfeldt

[57] ABSTRACT

A headphone having a dual element speaker unit including a face plate having an opening generally centrally located therein. A case coupler is mounted in the opening, and has an annular projection protruding through the opening. A first dynamic transducer is mounted within that annular projection. A second dynamic transducer is mounted to the case coupler opposite the first transducer. The case coupler includes an isolating plate, positioned between the first and second transducers, for sonically isolating the first transducer from the second. A grill plate is mounted over the annular projection, for providing a load to the first transducer. The isolating plate includes an opening, located outside the periphery of the annular projection, for allowing the passage of sound from the second transducer to the listener. A support assembly is connected to the face plate, and a cup assembly in turn connected to the support assembly. The support assembly includes means for allowing relative pivoting movement between the cup assembly and the face plate. The support assembly includes a ball and socket arrangement resulting in the relative motion allowed between the cup assembly and the face plate being biaxial. A bellows member is positioned between the cup and the face plate for damping movement between the cup assembly and the face plate, and for enclosing and directing sound waves generated by the transducers. A unique plug arrangement is provided for connecting the cord to the headphone apparatus.

9 Claims, 3 Drawing Sheets

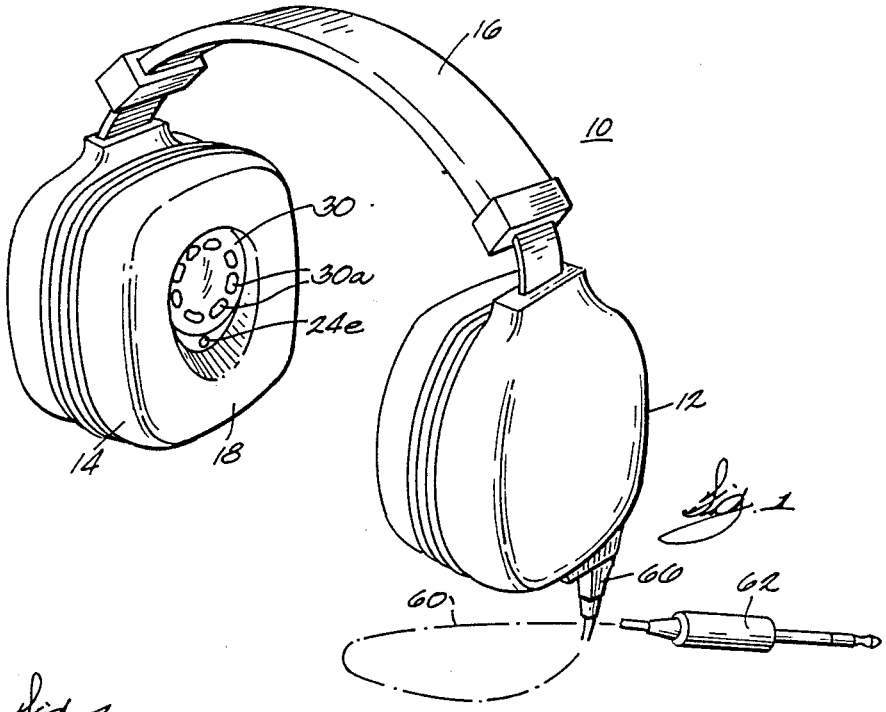
Fig. 1
Fig. 4
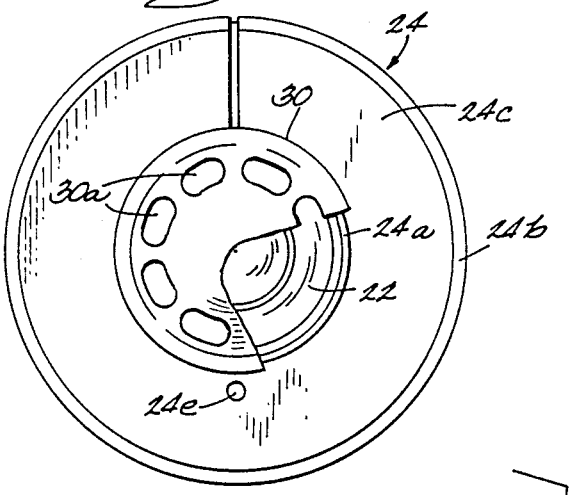
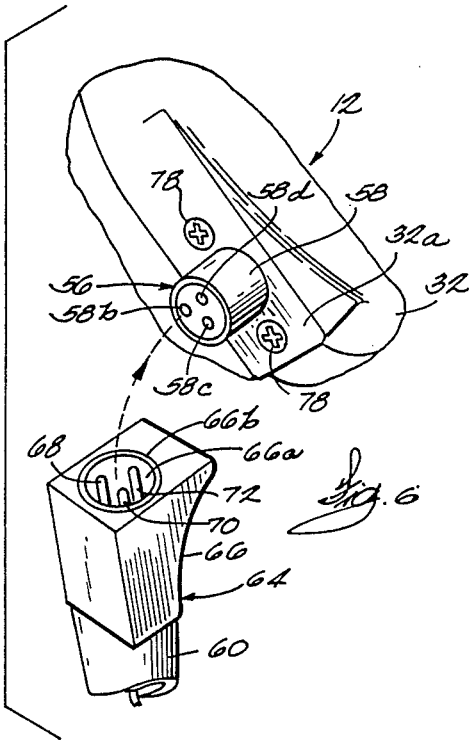
Fig. 6
Fig. 7
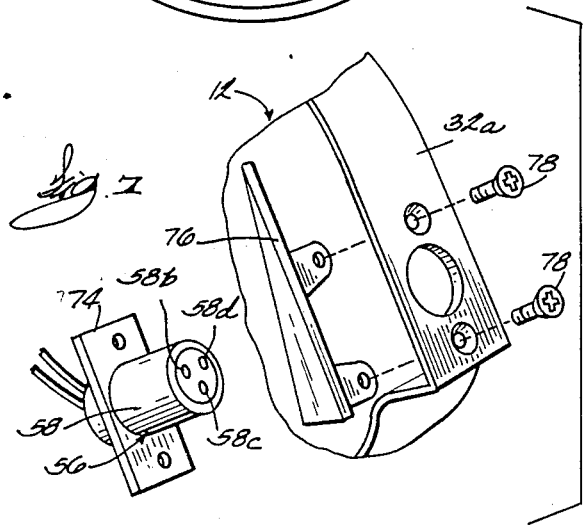

STEREO HEADPHONE

BACKGROUND OF THE INVENTION

The present invention relates to stereo headphones, and particularly to those high quality closed stereo headphones which are produced for the high fidelity market.

It is known that, when considering the design of a closed stereo headphone for faithfully reproducing frequencies over the entire audio spectrum, a single acoustic transducer in each of two earcup assemblies is inadequate, resulting in compromises in either the low frequency response or the high frequency response of the headphone. Hence it is recognized that a plurality of transducers are required to be provided for each earcup assembly, each transducer directed to a particular range of the audio spectrum, with crossover means for determining which transducer carries which portion of the spectrum. The transducers most suited to high fidelity sound reproduction are dynamic transducers. Dynamic transducers, however, characteristically are adversely affected by sound waves generated by other dynamic transducers, thereby causing undesirable distortion if the sound waves from one transducer are allowed to impact on or strike the diaphragms of the others. To the present, a suitable relative arrangement of dynamic transducers has not been provided which ensures that each transducer will not adversely affect the operation of each other transducer, particularly where a plurality of dynamic transducers are employed together in each earcup assembly.

This invention relates to improvements to the apparatus set forth above and to solutions to the problems raised thereby as well as other problems set forth below.

SUMMARY OF THE INVENTION

The invention relates to a headphone having a dual element speaker unit. This speaker unit comprises a face plate having an opening generally centrally located therein. A case coupler is mounted in the opening, and has an annular projection protruding through the opening. A first dynamic transducer is mounted within that annular projection. A second dynamic transducer is mounted to the case coupler behind the first transducer. The case coupler includes an isolating plate, positioned between the first and second transducers, for sonically isolating the first transducer from the second. A grill plate is mounted over the annular projection, among other things for providing a load to the first transducer. This grill plate has openings, only around the periphery thereof but not near the center thereof, for allowing the passage of sound waves from the first transducer to the listener. The isolating plate includes an opening, located outside the periphery of the annular projection, for allowing the passage of sound from the second transducer to the listener. A support assembly is connected to the face plate, and a cup assembly in turn connected to the support assembly. The support assembly includes means for allowing relative pivoting movement between the cup assembly and the face plate. The support assembly includes a ball and socket arrangement resulting in the relative motion allowed between the cup assembly and the face plate being biaxial. A bellows member is positioned between the cup and the face plate for damping movement between the cup assembly and the face plate, and for enclosing and directing sound waves generated by the transducers.

The invention further includes a cord for connecting the transducers to a source of stereophonic electrical signals, and means for physically and electrically connecting the cord to the ear cup. The connecting means includes a plug connected to an end of the cord, and having a cylindrical opening in the end thereof. The inside of the cylindrical opening is coated with conductive material. The plug further includes two conductive pins, parallel to each other and spaced apart from each other, and eccentric from but parallel to the longitudinal axis of the cylindrical opening. A receptacle is provided for the plug, and attached to the ear cup. The receptacle includes a cylinder coated with conductive material and sized so as to fit snugly into the cylindrical opening of the plug. The receptacle further includes a pair of pin-sized cylindrical openings sized adapted to snugly receive the pins of the plug. These openings are coated with conductive material so as to conduct with the pins when in contact with them. The plug further includes a non-conductive positioning pin arranged within the cylindrical opening, parallel to and spaced apart from the conductive pins. Correspondingly, the receptacle further includes a cylindrical opening parallel to the pin-sized cylindrical openings for snugly receiving the positioning pin. The receptacle is secured to the ear cup by means of a sandwich plate affixed to the cylinder, normal to a longitudinal axis of the cylinder. The sandwich plate is fastened to the cup by means of threaded fasteners.

Other objects and advantages of the invention will become apparent hereinafter.

DESCRIPTION OF THE DRAWING

FIG. 1 is an isometric view of a headphone constructed according to a preferred embodiment of the invention.

FIG. 2 is a view in cross section of one of the cup assemblies shown in FIG. 1.

FIG. 4 is a front plan view of a case coupler, first transducer and grill plate constructed according to a preferred embodiment of the invention.

FIG. 4 is a cross sectional view of FIG. 2, taken along line 5—5 thereof.

FIG. 6 is an enlarged fragmentary isometric view of a portion of a cup assembly having a receptacle for the plug,, and showing the plug itself.

FIG. 7 is an exploded isometric view of the structure for mounting the receptacle to the respective earcup assembly, according to a preferred embodiment of the invention.

DESCRIPTION OF THE PREFERRED EMBODIMENTS

Figure 3:
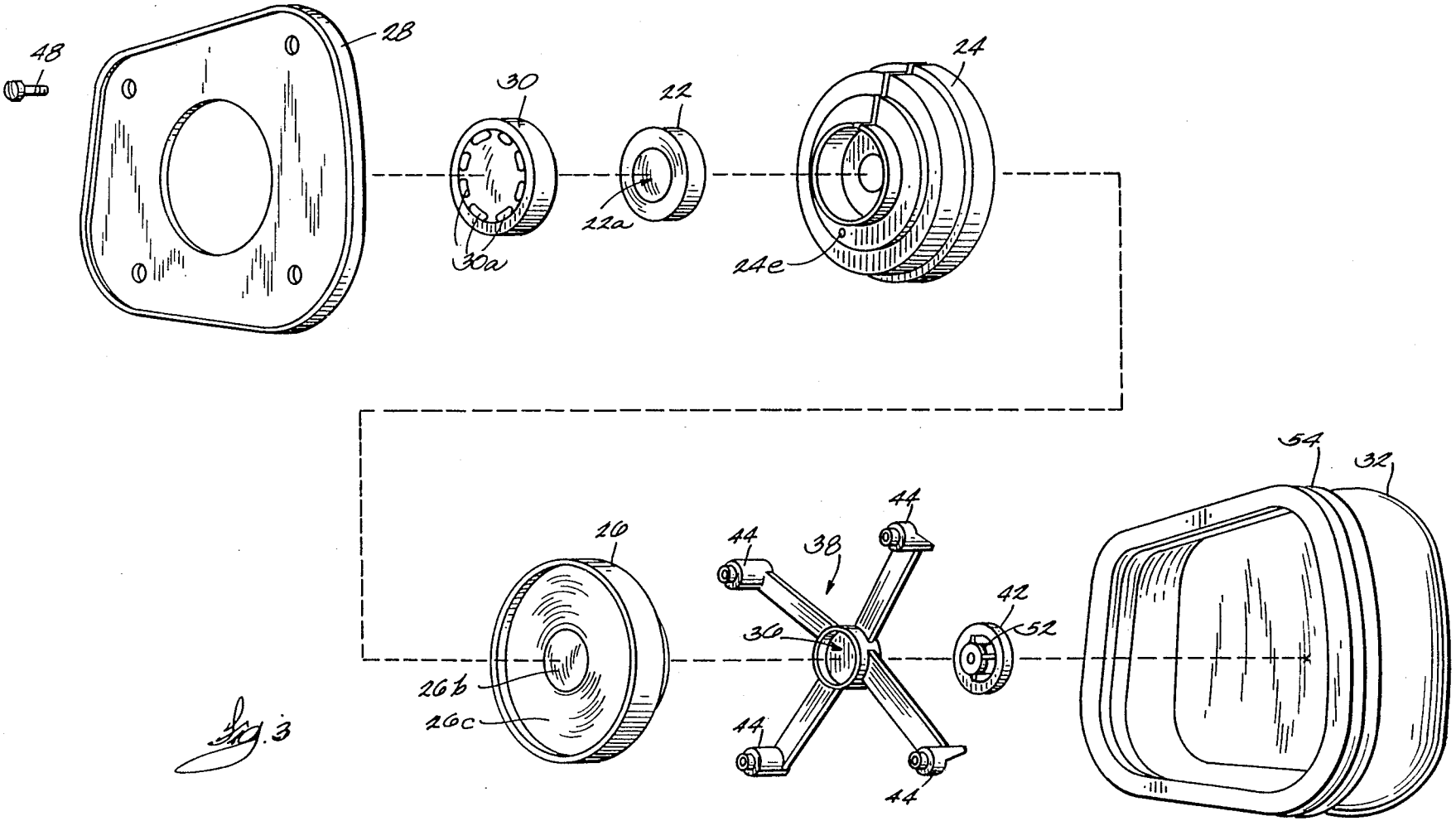
FIG. 3 is an exploded isometric view of a portion of the cup assembly shown in FIG. 2.
Figure 12:
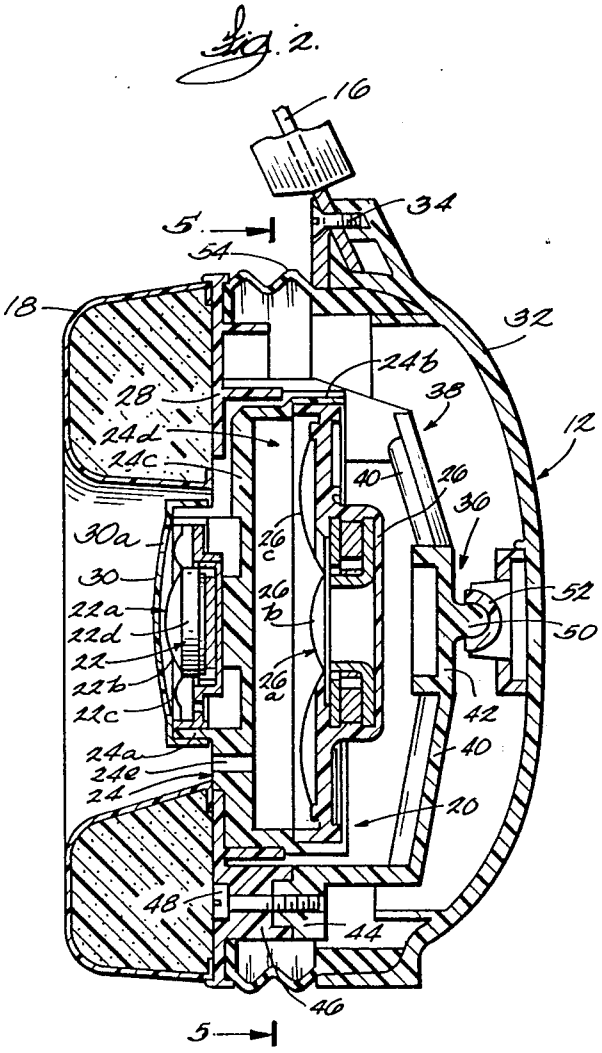

Referring now to FIG. 1, there is shown a closed headphone apparatus 10 constructed according to a preferred embodiment of the invention. As there shown, the apparatus 10 includes a pair of cup assemblies 12 and 14, each connected to a respective end of a headband 16. Each cup assembly 12 and 14 includes sound openings **24*e* and 30*a* directed inward, that is, toward the opposite cup assembly. These sound openings 24*e* and 30*a* are surrounded by ear cushions 18, which are provided for the purpose of sealing around the user's ears and keeping in the sound reproduced within the earcup assemblies 12 and 14**.

FIGS. 2, 3, 4 and 5 show detail of the earcup assemblies 12 and 14. Referring particularly now to FIGS. 2 and 3, each earcup assembly 12 and 14 includes a dual element transducer assembly 20. This transducer assembly 20 includes a first, high-range, dynamic transducer 22 mounted into a case coupler 24, and particularly into an annular ring 24a projecting outward from the front of the case coupler, that is, toward a listener's ear. As shown best in FIG. 3, the case coupler 24 is of a one-piece construction, with an annular ring 24a, referred to above, smaller in diameter than the case coupler itself, projecting from its front and connected to a second ring 24b, of the same diameter as the case coupler 24 itself by a transversely oriented case coupler isolation plate 24c. The second ring 24b extends outward from the back of isolation plate 24c, that is, away from the listener's ear. A second, low-range, dynamic transducer 26 is fitted within that second ring 24b, facing toward the listener's ear, and thus directly toward isolation plate 24c. Hence the low frequency sound produced by the second transducer 26 is prevented from impacting on the first transducer 22, thus preventing distortion of the sound produced by the first transducer.

The width of the second ring 24b is such that a cavity or chamber 24d is formed between the second transducer 26 and isolation plate 24c. The size of this chamber 24d is preferred to be 15.000 cubic centimeters, or at least within the range of 13 to 17 cubic centimeters. The sound produced by the second transducer 26 is permitted to reach the listener by means of a single small opening 24e through the isolation plate 24c, located outside the smaller ring 24a. Since the rings 24a and 24b are coaxial, the transducers 22 and 26 are coaxial with respect to each other. Thus, as the transducers 22 and 26 are mounted according to the present invention, the sound waves created by each are prevented from substantially affecting the diaphragm of the other by the isolation plate 24c, while the listener still hears full sound from each. Distortion as between the ranges of the respective transducers 22 and 26 is thereby substantially reduced.

The case coupler 24 thus not only provides physical support for the transducers 22 and 26, but also provides frequency limiting to second transducer 26. In effect the case coupler 24 acts as a Helmholtz resonator, with the low frequency output heard by the listener being the output of the sound opening 24e connecting the air mass or volume in the case coupler 24 with the air mass or volume enclosed by the ear cushion 18 around the listener's ear. Preferably the opening 24e is between 0.089 and 0.099 inches, and most preferably 0.094 inches, in diameter. Further, as shown best in FIG. 2, since the isolation plate 24c of the case coupler 24 has a certain thickness to it, which thickness varies depending upon the area of the isolation plate to which reference is being made, that thickness of the isolation plate at the point of the sound opening 24e results in a finite length of the sound opening. The preferred length of the sound opening 24e, as shown best in FIG. 2, is between 0.205 and 0.225 inches, and most preferably 0.215 inches. The dimensions of the length and diameter of the sound opening and the size of the chamber 24d are critical, as any sizes outside of the ranges disclosed can adversely affect bass response of the headphone apparatus 10.

The transducer assembly 20 is connected by bonding to a face plate 28, which face plate is larger than the case coupler 24. The first transducer 22 and the annular ring 24a project through the face plate 28, and the opening 24e is open to the front of the face plate, that is, toward the listener, through an opening provided in the face plate for that purpose. As shown best in FIG. 4, a grill plate 30 is applied over the first transducer 22, both for protection purposes and to provide an acoustical load or phase delay, as will be explained presently. The grill plate is preferably attached by press fitting it over the annular ring 24a of the case coupler 24.

Sound openings 30a are provided near the edges of the grill plate 30. The pattern of the sound openings 30a of the grill cover 30 is selected to provide the maximum output at a predetermined relatively high frequency, preferably 10 KHz. To this end, the openings 30a are located near the outer edge of the grill cover 30, leaving the center of the cover closed, so as to act as a phasing plug. Since each of the transducers 22 and 26 is a dynamic transducer, each has a diaphragm 22a and 26a respectively. Conventionally, each of the diaphragms 22a and 26a has a center dome area 22b and 26b, and an outer region 22c and 26c. The fact that the center of the grill cover 30 is closed has the effect of delaying the acoustic output of the center dome area 22b of the diaphragm 22a, and allowing that output to exit in phase with the output of the outer region 22c.

The ear cushion 18 is then bonded to the face plate 28 by any suitable means so that the sound openings 24e and 30a are not covered.

The first transducer 22, the high frequency transducer, is constructed using copper clad aluminum wire in its voice coil 22d. Because the majority of the conduction of the high frequency signal occurs in the copper cladding, due to the "skin depth" effect, conduction of the high frequency signal is excellent. The aluminum core of the wire, comprising the majority of the cross-sectional area of the wire, is relatively light in weight, and thus provides good physical response to the high frequency signals, reducing loss of audio energy and further improving the high frequency performance of the transducer 22.

In order to provide comfort and appropriate fit to a wide range of listeners, it has been customary to construct headphone assemblies so as to permit a certain amount of pivoting motion of the earcup assemblies with respect to the headband of the headphone. The method used in the past, however, as illustrated in U.S. Pat. No. 4,418,248, assigned to the assignee of the present invention, was to terminate each end of the headband in a forked yoke. According to the arrangement there disclosed, each tine of which yoke was pivotably attached to the outside of the respective earcup assembly. While this arrangement did permit a certain amount of pivoting, the pivoting was allowed along only one axis, and a greater degree of freedom than permitted by this arrangement is needed.

Figure 5:
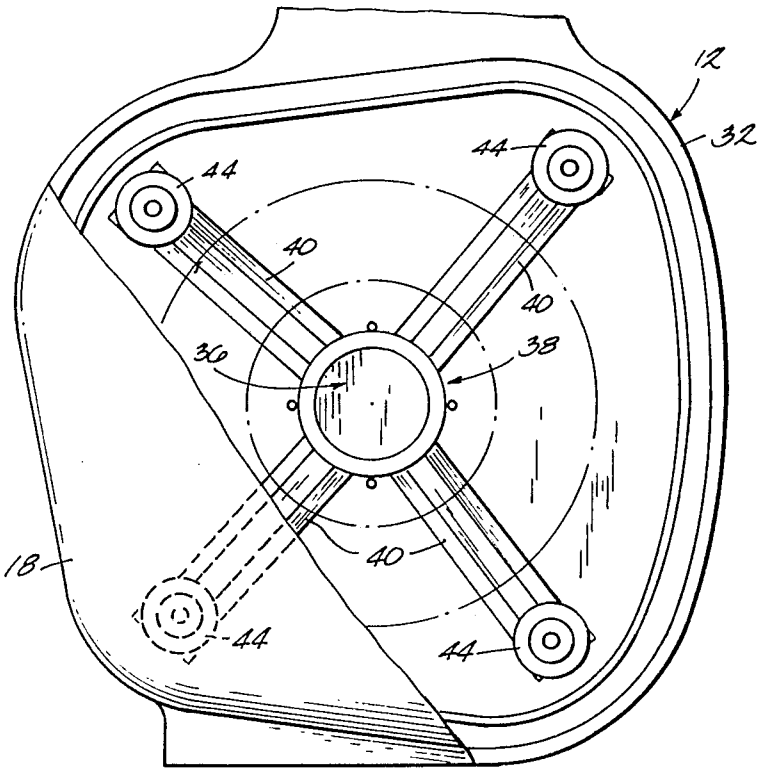

In the present invention, as shown best at FIGS. 2 and 3, headband 16 is rigidly affixed to an earcup assembly cover 32 by any suitable removable means such as threaded fasteners 34. The face plate 28 is connected to the cover 32 by a pivoting means 36 which allows relative motion between the face plate and the cover along more than one axis. In particular, in the most preferred embodiment, the pivoting means includes a spider member 38 having legs 40 rigidly extending outward from a central hub 42, as shown in FIG. 5. At the distal end of each leg 40 is a foot 44. The face plate 28 is provided with footings 46, each matching in position a respective foot 44. Thus the spider 38 is attached to the face plate 28 by connecting the footings 46 of the face plate to the feet 44 of the spider by any suitable means, such as threaded fasteners 48. A ball 50 integrally formed on the hub 42 of the spider 38 is fitted into a socket, provided by a socket plate 52 which is attached to the inside surface of the cover 32, to permit universal pivoting of the hub, and thus the face plate 28, with respect to the cover over a certain range of movement. The socket 52 is attached to the inside of the cover 32 by any suitable permanent means such as ultrasonic welding.

The components are sized so as to result in a gap all around the periphery of the face plate 28, between the face plate and the cover 32. In this gap is provided any suitable flexible suspension or shock absorbing means for providing flex and float with the movement of the face plate 28 relative to the cover 32. In the preferred embodiment this suspension means is a bellows 54 having an accordion-type cross section and constructed of a flexible material such as neoprene, EPDM, or thermoplastic rubber, having a wall thickness of about 0.020 inches and a weighted durometer hardness of about 40 on the Shore A scale. Thus is provided a means of pivoting the face plate 28 with respect to the cover 32 along more than one axis, providing greater comfort to the listener because of the greater degree of flexibility. In addition, bellows 54 performs a sound and dirt sealing function, giving a closed effect to the earcup assembly and preventing the entry of dirt or other foreign materials into the interior of the earcup assembly.

Often, in using headphones, a listener may desire to change the cord by which the headphone assembly receives its signal, that is, connect a different cord than the one currently attached. This could be true for a number of reasons, including the fact that different lengths of cord may be appropriate and convenient for different uses of the headphones. For this reason it may be desirable to supply a cord which is removable from the headphone assembly. The problem in supplying a removable cord, though, has been that the plug-and-receptacle arrangement conventionally provided often resulted in poor mechanical or electrical connections, certainly after a number of uses, correspondingly reducing the sound performance of the connected headphones.

As shown in FIGS. 1 and 6, the present invention includes a unique plug-and-receptacle arrangement to satisfy the need stated above. According to a preferred embodiment of the present invention, although clearly the polarity can be reversed from that to be described, one of the earcup assemblies 12 and 14 includes a receptacle 56 as shown best in FIG. 6. As there shown, the receptacle 56 comprises a cylindrical projection 58 projecting through the cover 32 of the earcup 12. The outer surface **58*a* of the projection 58, though not the end, is made conductive, such as by gold plating. Three holes 58*b*, 58*c* and 58*d*, all of about the same size and depth, are formed axially in the end of the projection 58. Two of these holes 58*b* and 58*c* are lined with conductive metal. Thus, with the outer surface 58*a* and the two conductive holes 58*b* and 58*c*, a total of three contacts are provided for carrying the stereo audio signal to the headphone apparatus 10**.

At least one cord 60 is supplied with each headphone apparatus 10. As shown in FIG. 1, each such cord 60 has a conventional headphone jack plug 62 at the end thereof opposite the end that connects to the apparatus 10. The end that does connect to the apparatus 10 terminates in a plug 64 which fits on the receptacle 56. That is, the plug 64 includes a handle 66 with knurled sides for facilitating handling by the user. At the end of the plug 64 is an axial cylindrical opening **66*a* formed in the handle 66, and sized to just slidably fit over the projection 58. The inner surface 66*b* of cylindrical opening 66*a* is lined with a conductive metal. Within the cylindrical opening 66*a* are attached three axial pins 68, 70 and 72, which are arranged parallel to each other and spaced apart from each other. Pins 68 and 70 are conductive. Thus with inside surface 66*b* and pins 68 and 70, again three contacts are provided for carrying the stereo audio signal from the cord 60 to the headphone apparatus 10. Non-conductive pin 72 and hole 58*d* are dummy connectors, which act as positioning means to ensure that the plug 64 is not attached to the receptacle 56** in an incorrect polarity.

As shown best in FIG. 7, the receptacle 56 is attached to the respective earcup assembly 12 or 14 by a sandwich plate arrangement. That is, the cylindrical projection 58 is integrally formed with a flat plate 74 projecting perpendicularly outward therefrom at about the middle of the cylinder This plate 74 is anchored into the cover 32 by placing it on a flat surface **32*a* provided for that purpose therein. An anchor plate 76 is then attached over the plate 74 by any suitable means, such as threaded fasteners 78. Hence the sandwich plate arrangement referred to above. A secure means of connection between the cord 60 and the headphone apparatus 10** is thus ensured, guaranteeing good contact and faithful sound reproduction.

While the apparatus hereinbefore described is effectively adapted to fulfill the aforesaid objects, it is to be understood that the invention is not intended to be limited to the specific preferred embodiment of improved stereo headphone set forth above. Rather, it is to be taken as including all reasonable equivalents within the scope of the following claims.

We claim:

1. A headphone having a dual element speaker unit comprising, in combination:

a face plate having an opening generally centrally located therein;

a case coupler mounted in said opening, and having an annular projection protruding therethrough;

a first dynamic acoustic transducer mounted within said annular projection of said case coupler;

a second dynamic acoustic transducer mounted to said case coupler opposite said first transducer, between said first and second transducer for sonically isolating said first transducer from said second transducer.

2. A headphone as recited in claim 1 further comprising a grill plate mounted over said annular projection, for providing a load and phase delay to said first transducer.

3. A headphone as recited in claim 2 wherein said grill plate has openings for allowing the passage of sound waves only around the periphery thereof, and no such openings near the center thereof.

4. A headphone as recited in claim 1 wherein said isolator plate includes an opening for allowing the passage of sound, located outside the periphery of said annular projection.

5. A headphone as recited in claim 1 further comprising a support assembly connected to said face plate and a cup assembly connected to said support assembly, said support assembly including means for allowing relative pivoting movement between said cup assembly and said face plate.

6. A headphone having a dual element speaker unit comprising, in combination:

a face plate having an opening generally centrally located therein;

a case coupler mounted in said opening, and having an annular projection protruding therethrough;

a first acoustic transducer mounted within said annular projection of said case coupler;

a second acoustic transducer mounted to said case coupler opposite said first acoustic transducer;

said case coupler including an isolator plate positioned between said first and second transducers for sonically isolating said first transducer from said second transducer;

a support assembly connected to said face plate; and a cup assembly connected to said support assembly, said support assembly including means for allowing relative pivoting movement between said cup assembly and said face plate;

wherein said support assembly includes a ball and socket arrangement, whereby relative motion is permitted between said cup assembly and said face plate, and wherein said relative motion is biaxial.

7. A headphone is recited in claim 6 further comprising a bellows number positioned between said cup and said face plate, for damping movement between said cup assembly and said face plate, and for enclosing and directing sound waves generated by said transducers.

8. A headphone comprising, in combination:

a face plate having an opening generally centrally located therein;

a case coupler mounted in said opening, and carrying a plurality of acoustic transducers;

a cup assembly; and a support assembly for supporting said face plate and said case coupler with respect to said cup assembly and allowing relative pivoting movement between said cup assembly and said face plate, said support assembly including a ball and socket arrangement resulting in relative motion being permitted between said cup assembly and said face plate, and wherein said relative motion is biaxial.

9. A headphone as recited in claim 8 further comprising a bellows member positioned between said cup and said face plate, for damping movement between said cup assembly and said face plate, and for enclosing and directing sound waves generated by said transducers.

* * * * *

UNITED STATES PATENT AND TRADEMARK OFFICE

CERTIFICATE OF CORRECTION

PATENT NO. : 4,965,836

DATED : October 23, 1990

INVENTOR(S) : Eugene M. Andre, Allan G. Mlodzikowski and Seth R. Banks

It is certified that error appears in the above—identified patent and that said Letters Patent is hereby corrected as shown below:

Column 6, Line 51:
Insert --- said case coupler including an isolator plate positioned --- before "between".

Column 6, Line 51:
Delete "transducer" and substitute --- transducers ---.

Column 8, Line 3:
Delete "is" and substitute --- as ---.

Column 8, Line 4:
Delete "number" and substitute --- member ---.

Title page:
Change the inventor's name to --- Allan G. Mlodzikowski ---.

Signed and Sealed this

Eighteenth Day of February, 1992

*Attest:*

HARRY F. MANBECK, JR.

*Attesting Officer*

*Commissioner of Patents and Trademarks*